US008485455B2

(12) United States Patent
Fisenko

(10) Patent No.: US 8,485,455 B2
(45) Date of Patent: Jul. 16, 2013

(54) SUPERSONIC NOZZLE FOR BOILING LIQUID

(75) Inventor: Vladimir Vladimirovich Fisenko, St. Petersburg (RU)

(73) Assignee: Fisonic Holding Limited, Limassol (CY)

( * ) Notice: Subject to any disclaimer, the term of this patent is extended or adjusted under 35 U.S.C. 154(b) by 0 days.

(21) Appl. No.: 12/951,031

(22) Filed: Nov. 20, 2010

(65) Prior Publication Data

US 2012/0125954 A1 May 24, 2012

(51) Int. Cl.

| | |
|---|---|
| ***B05B 1/04*** | (2006.01) |
| ***B01F 3/04*** | (2006.01) |
| ***B01F 7/02*** | (2006.01) |
| ***B01D 47/02*** | (2006.01) |

(52) U.S. Cl.
USPC ..... 239/594; 239/595; 261/76

(58) Field of Classification Search
USPC ..... 239/533.12, 533.11, 589–601; 451/102
See application file for complete search history.

(56) References Cited

U.S. PATENT DOCUMENTS

| | | | | |
|---|---|---|---|---|
| 1,867,876 | A * | 7/1932 | Clark | 406/153 |
| 2,175,160 | A * | 10/1939 | Theodor et al. | 239/589 |
| 2,364,987 | A * | 12/1944 | Lee | 261/78.1 |
| 2,583,726 | A * | 1/1952 | Chalom | 451/36 |
| 2,931,169 | A * | 4/1960 | Glenn | 239/127.3 |
| 2,948,148 | A * | 8/1960 | Bertin et al. | 73/147 |
| 5,647,221 | A * | 7/1997 | Garris, Jr. | 62/116 |
| 2009/0121365 | A1 * | 5/2009 | Jacobs et al. | 261/76 |

FOREIGN PATENT DOCUMENTS

| | | |
|---|---|---|
| RU | 2420674 C2 | 3/2010 |
| RU | 2008138162 A | 3/2010 |

OTHER PUBLICATIONS

"Critical Two-Phase Streams" Atomizdat 1978 p. 50.
"Compressibility of The Heat Carriers . . . " Energoatomizdat 1987 p. 55.

* cited by examiner

*Primary Examiner* — Len Tran
*Assistant Examiner* — Justin Jonaitis
(74) *Attorney, Agent, or Firm* — Novak Druce Connolly Bove + Quigg LLP; Jonthan Jaech

(57) ABSTRACT

A supersonic nozzle (called a Fisenko nozzle) improves conversion efficiency of the pressure energy of the input medium into kinetic energy of a two-phase gas-liquid stream of the ejected medium. The nozzle for boiling liquid includes inlet and outlet sections that are respectively converging and diverging in the direction of the medium flow, between which is a minimal nozzle section. The profile for a proximal part of the diverging section of the nozzle is defined by a curve that is concave to the nozzle axis, which smoothly transitions to a curve that is convex to the nozzle axis through the critical nozzle section downstream of the nozzle minima. At the critical section, the flow reaches sonic velocity and the nozzle profile is neither convex nor concave.

3 Claims, 1 Drawing Sheet

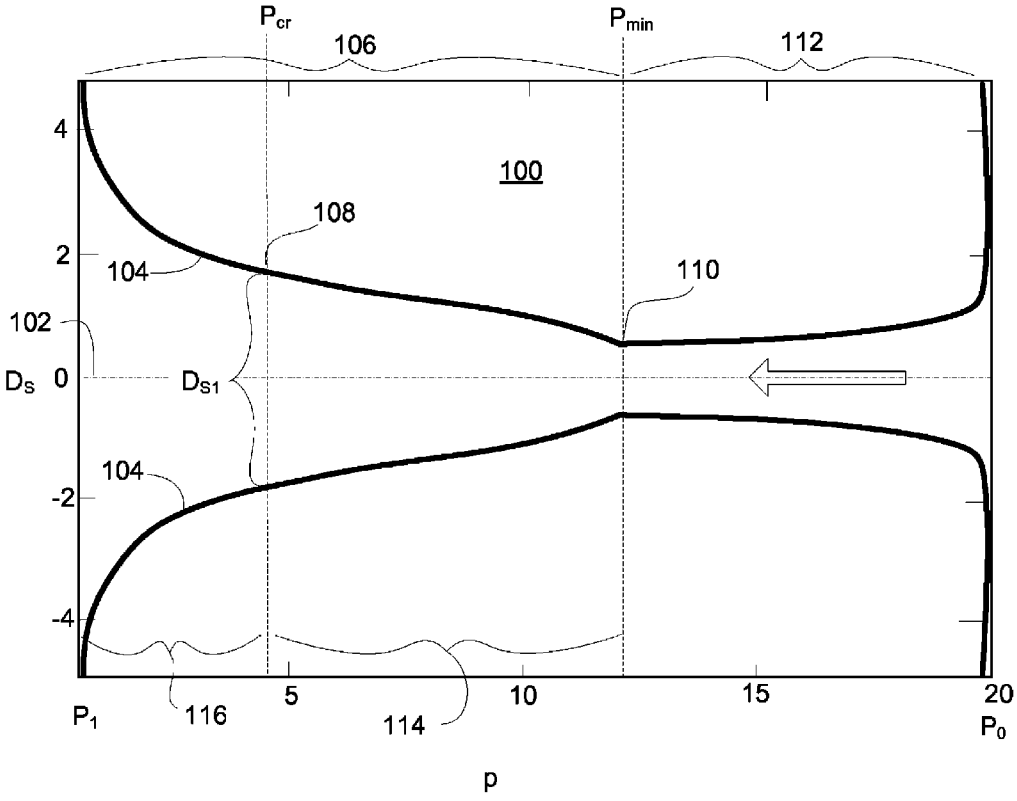
$P_{cr}$
$P_{min}$
106
112
100
108
104
110
102
$D_S$
0
$D_{S1}$
104
4
2
-2
-4
5
10
15
20
$P_1$
116
114
$P_0$
p

SUPERSONIC NOZZLE FOR BOILING LIQUID

BACKGROUND

1. Field

The present disclosure relates to fluidics, and more particularly to a nozzle apparatus for dispersal of different media using a homogenous two-phase stream of a medium, such as a boiling liquid.

2. Description of Related Art

A de Laval nozzle in the form of a converging-diverging channel for creation of a supersonic flow by passing a working medium through this channel under action of longitudinal pressure drop between the channel inlet and outlet is known in certain applications; for example got solid-propellant rocket engines. A de Laval nozzle is characterized by inlet and outlet sections that are respectively converging and diverging in the direction of the medium flow, between which a minimal cross-section is located. However, the de Laval nozzle does not allow an efficient conversion of pressure energy into kinetic energy of the media stream, particularly in the event that the liquid is fed to the inlet of the supersonic nozzle and a two-phase medium is formed during its boiling due to the pressure drop inside of the nozzle below the saturation pressure.

To improve efficiency with a two-phase medium, one supersonic de Laval type nozzle for boiling liquid facilitates conversion of the liquid flow into a two-phase vapor-liquid stream using a steam-generating element installed inside of the nozzle. However, the steam-generating element complicates the nozzle design, and increases hydraulic losses in the flow channel of the nozzle. This nozzle therefore does not optimize operation of the nozzle leaving its profile in the diverging section as in the traditional de Laval nozzle profile.

It would be desirable, therefore, to provide an apparatus to overcome these and other limitations of prior art supersonic nozzles, for example, by reducing hydraulic losses in a nozzle converting a liquid stream into a gas-liquid stream while improving efficiency of conversion of heat energy into mechanical work in the nozzle.

SUMMARY

A new design for a supersonic nozzle is disclosed. The new nozzle is capable of improving conversion efficiency of the pressure energy of the input medium into kinetic energy of a two-phase gas-liquid stream of the ejected medium, as compared to prior art nozzles. These and related advantages are achieved using the new supersonic nozzle of specific design as disclosed herein. Like a traditional de Laval nozzle, the new supersonic nozzle for boiling liquid includes inlet and outlet sections that are respectively converging and diverging in the direction of the medium flow, between which a minimal nozzle section, sometimes called a "throat," is located. However, unlike traditional nozzles, in the new nozzle the generating line of the fore part of the diverging section of the nozzle is formed by a curve that is concave to the nozzle axis and smoothly transitions to a curve that is convex to the nozzle axis in the critical nozzle section downstream of the nozzle throat. Surprisingly, when a traditional de Laval type nozzle design is modified according to the specific parameters as disclosed herein, the nozzle allows for efficient conversion of pressure energy into kinetic energy of the media stream, under circumstances wherein a two-phase medium is formed during boiling of an input liquid medium due to the pressure drop inside of the nozzle below the saturation pressure of the liquid medium. These advantages are realized without any hydraulic losses or design complications associated with prior nozzles that include a steam-generating element.

An more complete understanding of the supersonic nozzle for a boiling liquid will be afforded to those skilled in the art, as well as a realization of additional advantages and objects thereof, by a consideration of the following description. Reference will be made to the appended sheets of drawings which will first be described briefly.

BRIEF DESCRIPTION OF THE DRAWINGS

FIG. 1 is a chart showing an example of a nozzle profile according to the present technology.

DETAILED DESCRIPTION

Referring to FIG. 1, it should be appreciated that a nozzle 100 according to the present technology, sometimes called a Fisenko nozzle, is cylindrically symmetric around its central longitudinal axis 102, and the profile 104 represents a cross-section taken through such axis 102. The nozzle body may be constructed of any durable material compatible with the intended medium and working temperatures; for example, stainless steel or other metal alloys; ceramic; structural polymers; or various composite materials. The nozzle 100 may be formed in any suitable method to provide the nozzle profile as shown and described.

As noted above, in the new nozzle 100 the generating line for a proximal part of the diverging section 106 of the nozzle is formed by a curve 104 that is concave to the nozzle axis 102 in a concave section 114 and smoothly transitions to a curve that is convex to the nozzle axis in a convex section 116 downstream of the critical nozzle section 108, which is, in turn downstream of the nozzle throat 110. At the critical section 108, the profile 104 is neither concave nor convex. In more mathematically precise terms, the second-order derivative of the fore part 114 of the diverging section 106 of the nozzle along the length of the latter has a negative value; in the critical section 108, this derivative is equal to zero; and downstream of the critical section 108, this derivative has a positive value.

In addition, the nozzle profile 102 may further be characterized by a current channel diameter $D_s$ defined by $$D_s = \sqrt{\frac{G_s}{\rho_p W_p}} \quad \text{(Eq. 1)}$$

in any cross-section of the nozzle depending on current medium pressure p in this section, wherein:

$G_s$ is the given liquid mass flow rate through the nozzle;

$\rho_p$ is the liquid density in the current nozzle section;

$W_p$ is the liquid velocity in the current nozzle section.

Furthermore, diameter $D_{s1}$ of the critical nozzle section is $$D_{s1} = \sqrt{\frac{G_s}{g_{cr}}}, \quad \text{(Eq. 2)}$$

wherein:

$g_{cr}$ is the specific liquid mass flow rate, which is determined from the relation $g_{cr}=\rho_{cr}a_p$, $\rho_{cr}$ is the liquid density in the critical nozzle section, and $a_p$ is the critical stream velocity, which is equal to the sound velocity. The parameter $a_p$ is determined from the relation $$a_p = \sqrt{\left(\frac{k_p p_{cr}}{\rho_{cr}}\right)}, \quad \text{(Eq. 3)}$$

wherein $k_p$ is the adiabatic index for the current nozzle section. Furthermore, the adiabatic index $k_p$ is determined from relation $$k_p = 0.592 + \frac{0.7088}{\beta_p} \quad \text{(Eq. 4)}$$

provided that the homogenous two-phase mixture moving in the nozzle is a misty medium, and sizes of its particles are less than the length of their free path, and interaction of these particles is elastic, and where $0.5<\beta_p<1$ is the volumetric phase relation between liquid and gas phases in the stream of a water-steam medium in the critical section of the nozzle.

The dependence stated for $k_p$ is an approximation of the theoretical dependence of the adiabatic index for homogenous two-phase media obtained by the author (see Fisenko V. V. *Critical Two-phase Streams*.—M.: *Atomizdat,* 1978, p. 50, as well as Fisenko V. V. *Compressibility of the Heat Carriers and Efficiency of the Circulation Lines in the Nuclear Power Plants*.—M.: *Energoatomizdat,* 1987, p. 55). Using this dependence, parameters of the stream in any section of the nozzle are calculated in the function of pressure p, changing from pressure $P_0$ at the inlet of nozzle to pressure $P_1$ at its outlet.

In the process of performed experimental work, authenticity of the adopted assumptions was confirmed. Among other things, a possibility to achieve increase in the efficiency of conversion of the pressure energy into kinetic energy of a media mixture stream under boiling of the liquid in the flow channel of the nozzle was discovered, as compared to the de Laval nozzle. In addition, it was discovered that the critical section in the new design is located in the diverging area of the nozzle.

In general, the Fisenko nozzle as described herein—unlike the de Laval nozzle —possesses certain surprising characteristics, as follows. For example, the new nozzle is subsonic not only in its converging section, but also in some part of the diverging section downstream of the throat. For further example, maximal specific flow rate of the medium is established in the narrowest section of this nozzle (i.e., in the throat) but this section is not the critical section of the nozzle. Instead, the critical section, defined as the section where stream velocity is equal to the local sound velocity, is shifted downstream in this nozzle and is in the diverging section of the nozzle. Yet another surprising characteristic is that the second derivative of the sectional area along the nozzle length is equal to zero and not the first-order derivative; thus, the relation of the area of the Fisenko nozzle in the critical section to its length has not the minimum, as it is the case for the Laval nozzle but the flex of this relation.

This nature of the Fisenko nozzle profile dependence on its length is explained as follows. Liquid passing through the inlet section of the nozzle is heated from below to the saturation temperature. Due to narrowing of the nozzle, the stream velocity is increasing throughout this section; its pressure decreasing, and specific flow rate per sectional area unit increasing. This is the case until the pressure in the stream is equal to the saturation pressure at the set temperature, after which the liquid boils, the stream density sharply decreases, the stream velocity increases, and the sound velocity sharply decreases due to a sharp increase in stream compressibility; the derivative of the sectional area is increasing along the nozzle length. This is the case until the volumetric phase relation has reached its value equal to 0.5, after which the stream velocity continues growing, but the sound velocity starts growing as well, grow rate of the derivative of the sectional area from the nozzle length is decreasing, and then while the gas fraction in the mixture is increasing and its compressibility is more and more approaching to the gas compressibility, the outlet section of the supersonic section of the nozzle is approaching to the profile of a conventional Laval nozzle.

Basic length $L_0$ (mm) of the nozzle is selected in the process of construction of a particular nozzle profile. Current pressure value p is changing on this length from its maximal value $P_0$ at the inlet of the nozzle to its value $P_1$ in the outlet section, and the relation of the pressure difference between the inlet and outlet sections of the nozzle to the basic length enables construction of the dependence of the nozzle profile change on pressure using the above mathematical relations of parameters.

The invention is explained by the drawing, in which the profile of the flow channel of the supersonic nozzle for boiling liquid is presented schematically.

Referring again to FIG. 1, in the depicted example, $P_0$=2 MPa and $P_1$=0.01 MPa. Stream flow is from right to left. The proposed supersonic nozzle for boiling liquid consists of the inlet 112 and outlet 106 sections, which are respectively converging and diverging in the direction of the medium flow and the minimal (narrowest) nozzle section 110 or throat, which is located between them, in which the maximal specific liquid flow rate is established (shown in the drawing with dotted line $p_{min}$). Generating line of the section 106 of the nozzle, diverging in the direction of the medium flow, is formed by the curve, which is concave to the nozzle axis and smoothly going into a curve, which is convex to the nozzle axis in the critical nozzle section, i.e. in the nozzle section, where the flow is reaching the sound velocity (dotted line $p_{cr}$ in the drawing). Current diameter $D_s$ and other parameters of the nozzle 100 are as defined by Equations 1-4 above.

In operation of the supersonic nozzle 100, the subsonic stream of the liquid is converted into a supersonic stream of a gas-liquid, vapor-liquid, or vapor-gas-liquid mixture at the outlet of the nozzle as a result of the geometric influence on the gas stream of a saturated or heated liquid in the inlet converging section 112 and then in the outlet diverging section 106 of the nozzle due to conversion of the pressurized liquid stream into a high-speed stream, in which the static pressure is sharply decreasing.

The above supersonic nozzle can be used in power engineering, and transport, as well as in food, chemical, pharmaceutical, oil refining, and other industries, in which the current interest is to obtain a supersonic stream of a homogenous two-phase mixture from gas of a saturated or heated liquid both for efficient conversion of potential energy of the liquid into kinetic energy of the mixture and preparation of a homogenous mixture of different substances and obtaining of a homogenous mixture with a well-developed phase interface, in which any exchange processes and chemical reactions take place intensively. While examples are given for a water/steam medium, the invention is not limited thereby. The following claims should be interpreted in view of the foregoing specification, but are not limited by any specific examples or description that is not expressly defined in the claims.

What is claimed is:

1. A supersonic nozzle for boiling liquid, comprising: an inlet section coupled via a throat to an outlet section, the inlet section continuously converges along a flow direction for the nozzle from an inlet of the nozzle to the throat, and the outlet section continuously diverging along all points of a flow direction for the nozzle from the throat to an outlet of the nozzle, wherein the outlet section has a concave profile in relation to a central nozzle axis immediately downstream of the throat, and the concave profile transitions at a critical section located downstream of the throat to a convex smoothly curved profile in relation to the nozzle axis downstream of the critical section through a smooth profile that is neither concave nor convex at the critical section, wherein the convex profile defines an enclosed channel portion of the outlet section that is located upstream of the outlet of the nozzle.

2. The supersonic nozzle of claim 1, wherein the critical section is located in a diverging section of the nozzle.

3. The supersonic nozzle of claim 1, wherein the throat comprises an abrupt discontinuity between respective profiles of the inlet section and the outlet section.

* * * * *